US006681888B2

(12) United States Patent
Lepoutre

(10) Patent No.: US 6,681,888 B2
(45) Date of Patent: Jan. 27, 2004

(54) SILENCING APPARATUS, NOTABLY FOR A TURBO ENGINE

(75) Inventor: Henri Lepoutre, Roubaix (FR)

(73) Assignee: Westaflex-Automobile (FR)

( * ) Notice: Subject to any disclaimer, the term of this patent is extended or adjusted under 35 U.S.C. 154(b) by 12 days.

(21) Appl. No.: 09/990,400

(22) Filed: Nov. 21, 2001

(65) Prior Publication Data

US 2002/0070075 A1 Jun. 13, 2002

(30) Foreign Application Priority Data

Nov. 23, 2000 (FR) ..... 00 15100

(51) Int. Cl.[7] ..... F01N 1/02; F01N 1/00; F01N 1/08

(52) U.S. Cl. ..... 181/249; 181/255; 181/269; 181/272

(58) Field of Search ..... 181/249, 250, 181/255, 264, 269, 272, 273, 276, 281, 227, 228; 123/184.57

(56) References Cited

U.S. PATENT DOCUMENTS

| | | | | | |
|---|---|---|---|---|---|
| 4,111,278 A | * | 9/1978 | Bergman | 181/249 |
| 4,192,404 A | * | 3/1980 | Nakagawa et al. | 181/272 |
| 4,574,913 A | * | 3/1986 | Fukuda | 181/231 |
| 5,196,654 A | * | 3/1993 | DiFlora et al. | 181/229 |
| 5,208,429 A | * | 5/1993 | Field | 181/229 |
| 5,285,026 A | * | 2/1994 | Lemetyinen | 181/224 |
| 5,349,141 A | | 9/1994 | Horibe et al. | 181/224 |
| 5,446,790 A | | 8/1995 | Tanaka et al. | 381/71 |
| 5,841,080 A | * | 11/1998 | Iida et al. | 181/225 |

FOREIGN PATENT DOCUMENTS

| | | | | |
|---|---|---|---|---|
| JP | 56050283 A | * | 5/1981 | F04B/39/00 |
| JP | 05163924 A | * | 6/1993 | F01N/1/02 |
| JP | 05163925 A | * | 6/1993 | F01N/1/02 |
| JP | 05240120 A | * | 9/1993 | F02M/35/12 |

OTHER PUBLICATIONS

Japanese Patent Abstract, Publication No. 60030463, published 02/85, 1 page.
Japanese Patent Abstract, Publication No. 06010647, published 01/94, 1 page.
Japanese Patent Abstract, Publication No. 06108819, published 04/94, 1 page.
Japanese Patent Abstract, Publication No. 09053529, published 02/97, 1 page.
Japanese Patent Abstract, Publication No. 11044266, published 02/99, 1 page.

* cited by examiner

*Primary Examiner*—Robert Nappi
*Assistant Examiner*—Edgardo San Martin
(74) *Attorney, Agent, or Firm*—Renner, Kenner, Greive, Bobak, Taylor & Weber

(57) ABSTRACT

A silencing apparatus to be fitted between a first air or fluid intake duct (1) and a second air or fluid exhaust duct (2), said silencing apparatus being notably fitted between an engine turbine and a thermal exchanger and including a cylindrical main hollow body (3), a cylindrical input connection (4) and a cylindrical output connection (4') with one or a plurality of straight sections smaller than the straight section of said main body (3), and at least one partitioning part (8) defining with the internal surface of said main hollow body at least two toric chambers (9, 10).

11 Claims, 1 Drawing Sheet

SILENCING APPARATUS, NOTABLY FOR A TURBO ENGINE

BACKGROUND OF THE INVENTION

1. Field of the Invention

The present invention relates to a silencing apparatus to fit between an air intake duct for combustion air, for instance combustion air released from an engine turbine and an air exhaust duct through which air or combustion fluid exits, for instance towards a thermal exchanger.

2. Description of Related Art

Silencing apparatus of this type are already known from the prior art. According to the prior art, said silencing apparatus usually comprise a main hollow body with a circular, cylindrical shape and both an input connection and an output connection also respectively with a circular, cylindrical shape, each of which having a diameter smaller than the diameter of said main body, such that said input connection and output connection are fitted to either side of said main body.

At least one part forms a partition with the internal surface of said main hollow body, wherein said partition defines at least two toric chambers within the internal volume of said main body, which are defined between the diameter of said body and the diameter of said connections in a transversal perspective. Said toric chambers communicate directly with a virtual cylinder, which is defined by the diameter of said connections and within which the fluid moves from one connection to the other, by means of a circular slit which extends over the entire periphery of said virtual cylinder.

The apparatus according to the prior art feature many disadvantages. Firstly, the dimensions of said circular slits are too large in order to facilitate the manufacturing process. Increased losses of the inherent charge of the fluid transiting within the resonance chambers thus occur as air transits between said input connection and said output connection.

Moreover, the positioning of said partitioning part is critical when implementing this type of silencing apparatus. The width of said toric chambers must indeed precisely depend upon the frequency of the sound waves to be absorbed. Consequently, said part must be very accurately positioned. This is a time-consuming task, which is a problem within the scope of mass manufacturing. Finally, the manufacturing process of said main hollow body is itself complicated.

The present invention aims to remedy the above disadvantages by providing a new silencing apparatus fitted between an air intake duct and an air or fluid exhaust duct, which is easy to manufacture and notably does not require many stamping tools, whilst also reducing said loss of charge within said silencer.

BRIEF SUMMARY OF THE INVENTION

According to a preferred embodiment of the present invention, the silencing apparatus is fitted between a first air or fluid intake duct and a second air or fluid exhaust duct, said silencing apparatus being notably fitted between an engine turbine and a thermal exchanger; said silencer comprising a cylindrical main hollow body, a cylindrical input connection and a cylindrical output connection with a smaller straight section than the straight section of said main body, and at least one partitioning part defining with the internal surface of said main hollow body at least two toric chambers within the portion of said main body located around the virtual cylinder defined by the virtual extension of each of said connections toward one another, each of said toric chambers communicating directly with said virtual cylinder following a slit extending over the entire periphery thereof; is characterized in that said toric chambers are partly separated from said virtual cylinder by said partitioning part and/or one and/or both ducts between which said silencer is fitted.

The external walls of both the input connection and the output connection and an auxilliary wall formed by the partitioning part, which separates both chambers shaped as a body are used in order to minimise the dimension of the communicating slit between said chambers in the direction of the flow as well as the main flow of fluid, such that the incidental loss of charge is reduced in a simple manner without however requiring additional tools or parts.

In an improved embodiment of the present invention, one or a plurality of partitioning parts are cylindrical parts, the generating curvature of which includes a first straight segment defining a separating wall between the toric chambers and the virtual cylinder, a second straight segment defining a separating wall between two toric chambers and a third straight segment defining a corner with said second segment in a perspective parallel to the flow of fluid. An annular recess is shaped within the internal surface of the hollow body and said corner butts against a lateral wall of said recess such that an accurate positioning of the partitioning part is easily achieved when said third segment is welded to said recess. Accordingly, an accurate dimension of the resonance chambers is also easily achieved, whereby mass manufacturing is thus possible without however having to precisely measure the positioning of the partition for every instance.

In an improved embodiment of the present invention, the dimension of the width of said recess equals the dimension of said third straight segment of said partitioning part. The precision of the positioning is thus increased.

In an improved embodiment of the present invention, said main hollow body comprises two identical bells which can be joined to one another at the level of their respective outer edge.

In an improved embodiment of the present invention, said bells comprise a cylinder, the generating curvature of which comprises a first straight segment parallel to the flow axis and corresponding to a diameter equal to the diameter of the input duct or output duct, a second straight segment parallel to said first straight segment but farther away from the axis of said cylinder, and a third straight segment farther away still from the axis of said cylinder such that a recess is defined with the third segment of the other bell in the perspective of the axis of said cylinder, ie. the axis of the flow of fluids.

In an improved embodiment of the present invention, a third auxiliary toric chamber is implemented which communicates with the inside of said virtual cylinder by means of an aperture extending over less than three hundred and sixty degrees, notably less than two hundred and forty degrees, preferably less than one hundred and twenty degrees.

In an improved embodiment of the present invention, said third chamber is implemented by adding a second partition with a shape identical to the shape of the first partition.

BRIEF DESCRIPTION OF THE SEVERAL VIEWS OF THE DRAWINGS

The invention is illustrated with reference to the following drawings in which.

DETAILED DESCRIPTION OF THE INVENTION

Figure 1:
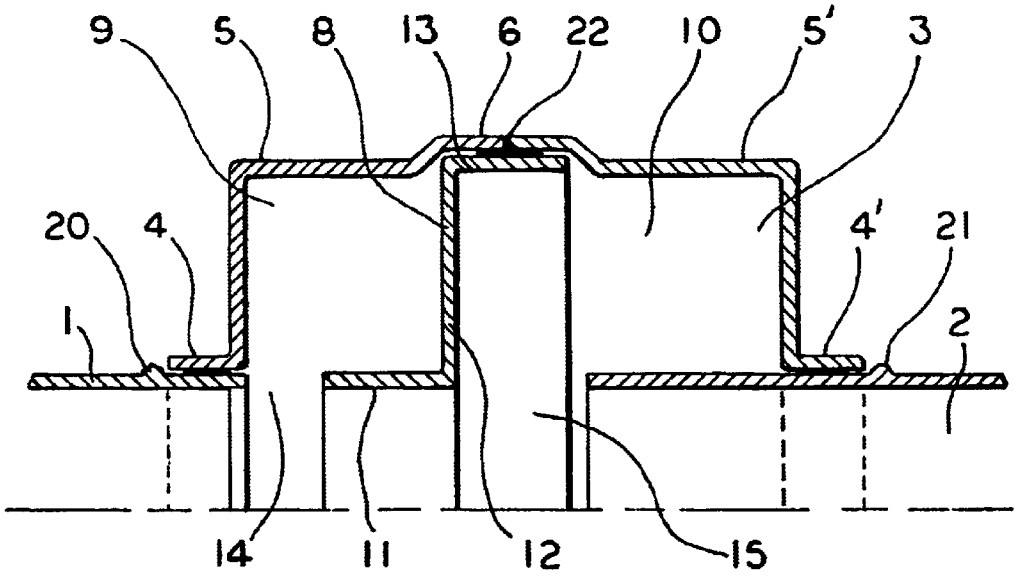
FIG. 1 shows a first embodiment of an apparatus according to the present invention.

A silencing apparatus is described in FIG. 1, wherein said silencer is fitted between an air intake duct 1 which is otherwise connected to the turbine of an engine (not shown) and an exhaust duct 2 connected directly or indirectly to a thermal exchanger by means of further ducts. Air flows between duct 1 and duct 2 The apparatus can also be used with an inverse airflow, whereby duct 2 is the air intake duct and duct 1 is the exhaust duct. It is an aim of the silencing apparatus to suppress or absorb noise generated by the turbine of the turbo engine. The well-known technique of the Helmholtz resonator is herein employed for this purpose. The silencing apparatus comprises a main hollow body 3 with a circular cylindrical shape. Said circular cylindrical main body comprises a first circular cylinder 4 forming the intake connection, a second circular cylinder 4' forming the exhaust connection, a third circular cylinder 5, a fourth circular cylinder 5' and a fifth circular cylinder 6, wherein said cylinders 5, 5' and 6 define the internal portion of said silencing apparatus. The diameter of said circular cylinder 6 is slightly larger than the diameter of circular cylinders 5 and 5', for instance between 0.2 mm and 5 mm. A cylindrical part 8 defines two Helmholtz chambers 9 and 10 within the main body. Said partitioning part 8 is a cylindrical part, the generating curvature in the perspective of the figure, i.e. the perspective parallel to the flow of fluid, of which comprises a first straight segment 11 parallel to the flow axis, a second intermediary straight segment 12 defining a partition and a third straight segment 13 which is farther way from the axis than the fist straight segment 11. The chamber 9 is delimited by the wall of the main body, the partition 12 and the straight segment 11, in the perspective of the figure. Said chamber 9 has a toric shape defined at a distance of the flow axis which is equal to the diameter of the connections and the ducts, and communicates with the virtual cylinder defined by both ducts 1 and 2 by means of an annular slit 14.

Moreover, chamber 10 is delimited by the wall of the external body on the one side and, on the other side, by the partition 12 and the portion of the wall of the duct 2 which stands out inside the hollow body. Said chamber 10 communicates with the inside of said virtual cylinder by means of an annular slit 15. The length of the straight segment 13 is preferably equal to the width of cylinder 6 in this perspective. Said cylinder 6 is welded to cylinder 13 by welding or brazing.

The corner that arises from the junction of segments 12 and 13 butts against the lateral walls of the recess 6, such that part 8 can be accurately positioned relative to the hollow body. The fact that the width of cylinder 6 is preferably equal to the width of cylinder 13 further ensures that the positioning of part 8 relative to the hollow body is always the same, when said part 8 is welded at the level of cylinder 6. Connections 4 and 4' have diameters slightly larger than the diameters of ducts 1 and 2 and are welded thereto after having been slid therein.

The silencer (the hollow body and the partitioning part) is made of stainless steel, with a thickness of 0.6 or 0.8 mm.

The hollow body comprises two halves, which take the shape of two bells. Each bell comprises a first small circular cylinder, a second circular cylinder with a larger diameter and a third circular cylinder with a diameter slightly larger than the second. The third circular cylinder with a larger diameter can be formed about the second circular cylinder by stamping. Both halves are joined at their outer edge at the level of the welding joint and the third cylinders of both bells form the positioning cylinder 6 once they have been welded to one another at the level of their outer edge 22.

The positioning of the two half-bells relative to the two ducts 1 and 2 is achieved by means of grooves 20, 21 (only shown in FIG. 1 but which may also be implemented in FIG. 2) implemented on the periphery of each duct 1 and 2, for instance three grooves at one hundred and twenty degrees from one another. The outer edges of connections 4 and 4' butt against said grooves such that the accurate positioning of said two connections relative to the two ducts they are to be inserted in is achieved before said connections are welded to said two ducts. An accurate positioning of the body of said silencing apparatus is therefore obtained relative to ducts 1 and 2, and thus an accurate width of said communicating slits between the toric chambers and the virtual cylinder is also obtained.

Figure 2:
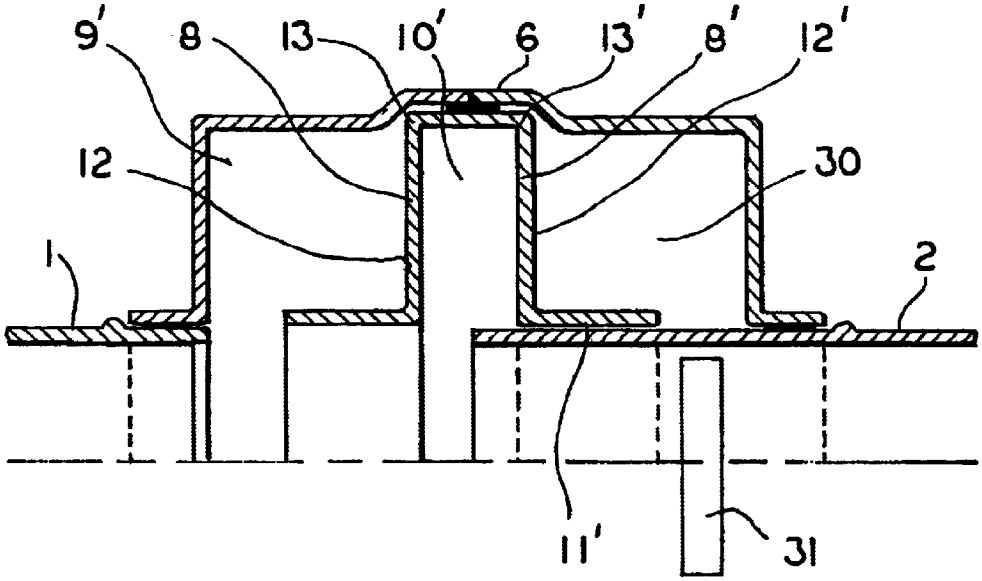
FIG. 2 shows another embodiment of an apparatus according to the present invention.

An alternative embodiment of a silencing apparatus according to the present invention is shown in FIG. 2. The parts thereof which are identical to the parts shown in FIG. 1 are designated with the same reference numbers.

Said alternative embodiment is a variation of the preferred embodiment by means of implementing a second partitioning part 8', the shape of which is identical to the shape of the first partitioning part 8, and also implementing a third toric chamber 30. Said third toric chamber 30 only communicates with the inside of the exhaust duct 2 by means of a rectangular aperture 31 extending over one hundred and twenty degrees of the periphery of said exhaust duct 2. This embodiment confers a relatively low resonance frequency to chamber 30 compared to the frequencies of chambers 9' and 10', such that the range of frequencies said silencing apparatus acts upon is increased.

Said chamber 30 does not in fact perform its function according to the principle of a Helmholtz resonator but according to the principle of a tube opened at each extremity, whereby said extremities are joined at the same connecting point.

Said part 8' is close to duct 2 by means of its segment 11'. However, they may be welded to one another or not, as shown in FIG. 2. Indeed, some slackness between both parts does not prejudice acoustical properties. Segments 13 and 13' of partitioning parts 8 and 8' respectively have the same dimensions, i.e. half of the width of the annular recess 6.

An extremity of each of segments 13 and 13' (i.e. the extremities forming a corner with segments 12 and 12' respectively) butts against its respective stopper formed by the lateral walls of said recess 6. Both parts 8 and 8' can therefore be accurately positioned by means of said corner-against-stopper positioning. The accuracy of said positioning is further enhanced by the fact that the sum of the respective lengths of segments 13 and 13' equals the width of said recess.

Silencing apparatus as shown in FIGS. 1 and 2 are not symmetrical. According to an alternative embodiment of a silencing apparatus according to the present invention, said silencing apparatus as shown in FIGS. 1 and 2 could be symmetrical. Moreover, said silencing apparatus as shown in FIGS. 1 and 2 may be used with air flowing in either direction, in the case of the non-symmetrical embodiments.

What is claimed is:

1. A silencing apparatus is fitted between a first fluid intake duct and a second fluid exhaust duct, said silencing apparatus being fitted between an engine turbine and a thermal exchanger;

said silencing apparatus comprising a cylindrical main hollow body, a cylindrical input connection and a cylindrical output connection with one or a plurality of straight sections smaller than the straight section of said main body, and at least one partitioning part defining with the internal surface of said main hollow body at least two toric chambers within the portion of said main body located around the virtual cylinder defined by the virtual extension of each of said connections toward one another, each of said toric chambers communicating directly with said virtual cylinder following a slit extending over the entire periphery thereof;

wherein said toric chambers are partly separated from said virtual cylinder by said partitioning part and at least one of the first and second ducts.

2. An apparatus according to claim 1, wherein said hollow body and connections are circular cylinders.

3. An apparatus according to claim 1, wherein said partitioning part is a cylindrical part, the generating curvature of which includes a first straight segment defining a separating wall between said toric chambers and said virtual cylinder, a second straight segment defining a separating wall between said two toric chambers and a third straight segment; and an annular recess is shaped within the internal surface of said hollow body such that the corner formed by both segments butts against either of the lateral walls of said recess.

4. An apparatus according to claim 3, wherein the dimension in width of said recess is preferably equal to the dimension of said third straight segment of said partitioning part.

5. An apparatus according to claim 1, wherein said main hollow body comprises two identical bells, which can be joined to one another at the level of their outer edge.

6. An apparatus according to claim 5, wherein each of said bells comprises a cylinder, the generating curvature of which comprises a first straight segment parallel to the flow axis and corresponding to a diameter equal to the diameter of the input duct or output duct, a second straight segment parallel to said first straight segment but farther away from the axis of said cylinder, and a third straight segment father away still from the axis of said cylinder such that a recess is defined with the third segment of the other bell, in the perspective of the axis of said cylinder, that is, the axis of the flow fluids.

7. An apparatus according to claim 1, wherein means for positioning connections relative to ducts are implemented as grooves raised in relief over the periphery of said ducts at a predetermined level at which the respective external edges of said connections butts against said grooves.

8. A silencing apparatus is fitted between a first fluid intake duct and a second fluid exhaust duct, said silencing apparatus being fitted between an engine turbine and a thermal exchanger;

said silencing apparatus comprising a cylindrical main hollow body, a cylindrical input connection and a cylindrical output connection with one or a plurality of straight sections smaller than the straight section of said main body, and at least one partitioning part defining with the internal surface of said main hollow body at least two toric chambers within the portion of said main body located around the virtual cylinder defined by the virtual extension of each of said connections toward one another, each of said toric chambers communicating directly with said virtual cylinder following a slit extending over the entire periphery thereof;

wherein said toric chambers are partly separated from said virtual cylinder by said partitioning part and at least one of the first and second ducts; and wherein at least one auxiliary toric chamber is implemented and communicates with the inside of said virtual cylinder by means of an aperture extending over less than three hundred and sixty degrees.

9. An apparatus according to claim 8 wherein said aperture extends over less than two hundred and forty degrees.

10. An apparatus according to claim 8 wherein said aperture extends over less than one hundred and twenty degrees.

11. An apparatus according to claim 8, wherein said third chamber is implemented by adding a second internal partition, the shape of which is similar to said first partition.

* * * * *